US005377437A

United States Patent [19]

Underwood

[11] Patent Number: 5,377,437

[45] Date of Patent: Jan. 3, 1995

[54] RIFLE AND PISTOL REST

[76] Inventor: John Underwood, Rte. 9, Box 564, Mocksville, N.C. 27028

[21] Appl. No.: 241,563

[22] Filed: May 12, 1994

Related U.S. Application Data

[62] Division of Ser. No. 125,698, Sep. 24, 1993, Pat. No. 5,317,826, which is a division of Ser. No. 924,923, Aug. 5, 1992, Pat. No. 5,318,693.

[51] Int. Cl.[6] ..... F41C 27/00

[52] U.S. Cl. ..... 42/94

[58] Field of Search ..... 42/94; 413/392; 135/114

[56] References Cited

U.S. PATENT DOCUMENTS

| | | | |
|---|---|---|---|
| 879,052 | 11/1908 | Jeranek | 42/94 |
| 1,277,435 | 6/1918 | Lesko | 42/94 |
| 1,298,920 | 4/1919 | Farago | 42/94 |
| 1,524,973 | 2/1925 | Hazelton | 42/94 |
| 2,569,435 | 9/1951 | Martin | 42/94 |
| 2,705,015 | 3/1955 | Langlais | 135/114 |
| 2,831,655 | 4/1958 | Hammer | 403/392 |
| 3,225,656 | 12/1965 | Flaherty et al. | 42/94 |
| 3,381,406 | 5/1968 | Ormond | 42/94 |
| 3,576,084 | 4/1971 | Anderson | 42/94 |
| 3,584,821 | 6/1971 | Glebe | 248/156 |
| 3,635,233 | 6/1972 | Robertson | 135/114 |
| 4,017,997 | 4/1977 | Peterson et al. | 42/94 |
| 4,063,830 | 12/1977 | Ban | 135/114 |
| 4,188,006 | 2/1980 | Karlin | 403/392 |
| 4,345,398 | 8/1982 | Pickett | 42/94 |
| 4,359,834 | 11/1982 | Beretta | 42/94 |
| 4,393,614 | 7/1983 | Pickett | 42/94 |
| 4,397,112 | 8/1983 | York | 42/94 |
| 4,575,964 | 3/1986 | Griffin | 42/94 |
| 4,676,021 | 6/1987 | Groba | 42/94 |
| 4,882,869 | 11/1989 | Webster | 42/94 |
| 4,893,427 | 1/1990 | Davidson | 42/94 |
| 4,979,531 | 12/1990 | Toor et al. | 135/114 |
| 5,194,678 | 3/1993 | Kramer | 42/94 |

*Primary Examiner*—David Brown

*Attorney, Agent, or Firm*—Antonelli, Terry, Stout & Kraus

[57] ABSTRACT

A firearm support includes a cylinder member which provides support without hindering the range of fire of a rifle or a pistol. The cylinder member is disposed on telescopic elongated elements which are fictionally clamped by a clamp. The firearm support further includes a perpetually open strap. Additionally, the firearm support is noiselessly foldable with one hand.

6 Claims, 7 Drawing Sheets

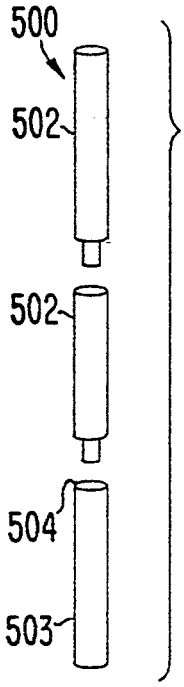
FIG. 30
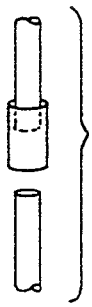
FIG. 31
FIG. 32
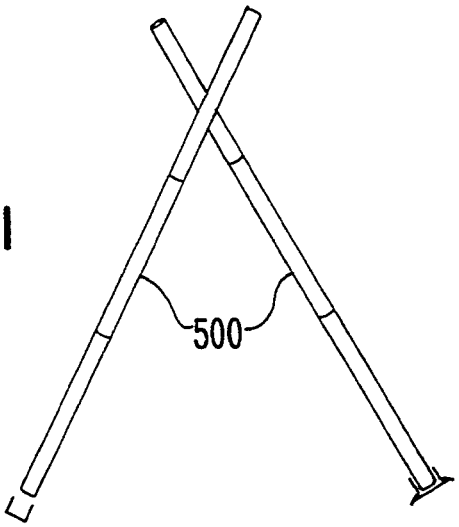
FIG. 26
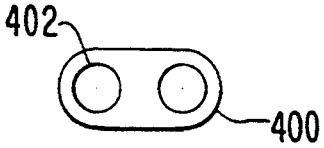
FIG. 28
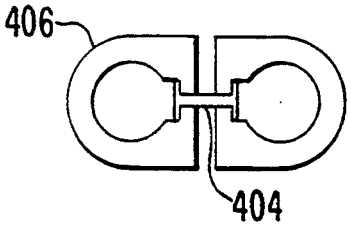
FIG. 27
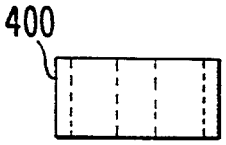
FIG. 29
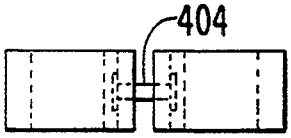

RIFLE AND PISTOL REST

This is a division of application Ser. No. 08/125,698, filed Sep. 24, 1993, now U.S. Pat. No. 5,317,826, issued Jun. 7, 1994, which in turn is a division of application Ser. No. 07/924,923, filed Aug. 5, 1992, now U.S. Pat. No. 5,318,693, issued May 17, 1994.

FIELD OF THE INVENTION

The invention relates to portable gun rests or firearm supports which can be used by an individual to support any one of a variety of guns such as rifles, shotguns and pistols, for example, in any one of the variety of firing positions and which can be easily transported by an individual in the field.

BACKGROUND OF THE INVENTION

Various gun rests have been proposed for supporting a variety of weapons.

One such gun rest has been proposed, for example, in U.S. Pat. No. 4,676,021, which discloses two upwardly and outwardly extending arms which form a Y-shaped means for receiving or holding a firearm. One disadvantage of firearms employing upwardly and outwardly extending arms which form a Y-shaped means resides in the fact that the arms themselves hinder the firearm from being moved either horizontally or vertically over a wide range without moving the entire support. As the target moves, the firearm must be able to move rapidly to follow the target in any direction.

Another firearm support has been proposed in U.S. Pat. No. 4,575,964, which discloses a pair of oppositely directed U-shaped saddle members at opposite ends, respectively, of an elongated telescopic support assembly. One saddle member is dimensioned to receive the forearm of a rifle, shotgun or the like. One disadvantage of such a firearm support which employs the U-shaped saddle member resides in the fact that the U-shaped saddle member which receives the rifle would hinder the horizontal and vertical movement of the firearm.

Another firearm support has been proposed in U.S. Pat. No. 4,393,614, which discloses a monopod clamp which is removably attached to the firearm barrel forward of the forestock. One disadvantage of firearm support employing the monopod clamp resides in the fact that the firearm support moves with the firearm, and the firearm support itself hinders the horizontal and vertical movement of the firearm.

Another firearm support has been proposed in U.S. Pat. No. 3,584,821, which includes a pointed shaft having a firearm support member slidably mounted thereon. One disadvantage of the firearm employing the pointed shaft resides in the fact that the shaft hinders the movement of the firearm particularly in the horizontal direction.

Another firearm support has been proposed in U.S. Pat. No. 3,576,084, which discloses a semi-circular support arm. The semi-circular support arm projects out of a V-way which is adapted to engage a post. One disadvantage of a firearm support employing the semi-circular support arm and the V-way resides in the fact that the semi-circular support hinders the movement of the firearm, particularly in the horizontal direction.

Another firearm support has been proposed in U.S. Pat. No. 3,225,656, which discloses a rifle cradle which is elevated by a collar and a wing screw which permits the cradle to turn in the horizontal plane. One disadvantage of the firearm support employing the cradle, collar and the wing screw resides in the fact that the rapid movement of the rifle is inhibited by the adjustment of the collar and the wing screw.

Another firearm support has been proposed in U.S. Pat. No. 1,298,920, which discloses a combination gun and knife. One disadvantage of the firearm support employing the knife resides in the fact that the knife hinders the free movement of the gun since the gun cannot be moved horizontally without moving the knife.

Another firearm support has been proposed in U.S. Pat. No. 1,277,435, which discloses a U-shaped receiving fork or a bracket transversely secured to a end of a shaft. One disadvantage of the firearm support employing the U-shaped receiving fork or bracket resides in the fact that the U-shaped receiving bracket or fork hinders the free movement of the barrel as the firearm cannot be moved without moving the receiving bracket.

Another firearm support has been proposed in U.S. Pat. No. 879,052, which discloses a stirrup having resilient arms for securing the free end of a gun in position. One disadvantage of the firearm support employing the resilient arms resides in the fact that the movement of the end of the gun is restricted by the resilient arms, particularly in the vertical direction.

SUMMARY OF THE INVENTION

It is an object of the present invention to construct a firearm support or gun rest in which the firearm support offers minimal impedance to the free movement of the firearm both in the horizontal and vertical directions and to provide a wide range of fire without moving the firearm support.

Further, it is an object of the present invention to allow the overall height of the firearm support to be adjusted to suit the user's needs.

Further, it is an object of the present invention to construct a firearm support which has a carrying strap which remains perpetually open.

Further, it is an object of the present invention to provide a firearm support in which the center gravity of the support for the firearm is disposed directly above the support assembly to provide a stable rest.

Further, it is an object of the present invention to provide a firearm support which can be mounted on any suitable surface such as the ground, a bench or tabletop or a tree limb, etc.

Such an unhindered firearm is important to achieve an accurate shot of the firearm while the user of the firearm is attempting to target a moving target. If the target is moving quickly the user must be able to follow the target with the firearm without the necessity of moving the firearm support and repositioning the firearm.

The present invention is constructed to provide a firearm support which has a low manufacturing cost, can provide a support for a firearm without hindering the movement of the gun in either the horizontal or vertical direction and provides a wide range of fire. The firearm support does not move with the firearm. The present invention provides a range of fire for a firearm of approximately 180° in both the horizontal and vertical directions without moving the firearm support in which the firearm is effectively unhindered by the firearm support. Yet, the firearm support of the present invention provides sufficient support for the firearm such that an accurate shot of the firearm can be attained.

It is an object of another feature of the invention to provide a firearm support which can be assembled with one hand. Further, it is an object of the present invention to provide a firearm support which is light weight and compact yet provides stable support.

Further, it is an object of the present invention to provide a firearm support which is packaged in a small package with respect to it assembled size.

Further, it is an object of the present invention to provide a firearm support which can be noiselessly or quietly assembled to avoid scaring the target.

It is important to provide such a firearm support which can be stored in a small container and be readily accessable for use.

Further, it is an object of the present invention to provide a firearm support which can be assembled in the field soundlessly so as not to alert or scare a potential target.

It is a further object of the present invention to provide a firearm support which can be assembled or disassembled with one hand.

In accordance with advantageous features of the present invention, a cylinder is mounted on a telescopic disposed tubular support element. The cylinder may be advantageously covered with rubber or plastic. The firearm assembly of the present invention can be readily picked-up and carried by a carrying strap which is perpetually open to facilitate placing it on the shoulder of a user or to facilitate storage of it while not in use.

In accordance with another advantageous feature of the present invention, a pair of elongate members having a padded portion is inserted through a first hole of a first flexible coupling member and a second hole of a second flexible coupling member to pivotably join the pair of elongate members. A third flexible coupling member having a third hole is positioned between the pair of elongate members. The elongate members are collapsible and foldable yet remain connected together by virtue of elastic members which join segments of the elongate members.

Additional arrangements of the firearm support are described in the claims.

BRIEF DESCRIPTION OF THE DRAWINGS

The above and other objects, features and advantages of the present invention will become more apparent from the following description when taken in connection with the accompanying drawings, which show, for the purpose of illustration only, several embodiments in accordance with the present invention, and wherein:

FIG. 26 is a schematic top elevational view of the pivoting member.

FIG. 27 is a side view of the pivot member.

FIG. 28 is a top view of another pivoting member with a joining pin.

FIG. 29 is a side view of the another pivoting member with joining pin of FIG. 28.

FIG. 30 is a schematic side elevational view of an elongated member of another gun rest frictionally connected.

FIG. 31 is a schematic partial view of another elongated member being frictionally connected.

FIG. 32 is a schematic side elevational view of the frictionally connected gun rest with two elongated members crossed.

DESCRIPTION OF THE PREFERRED EMBODIMENTS

Figure 1:
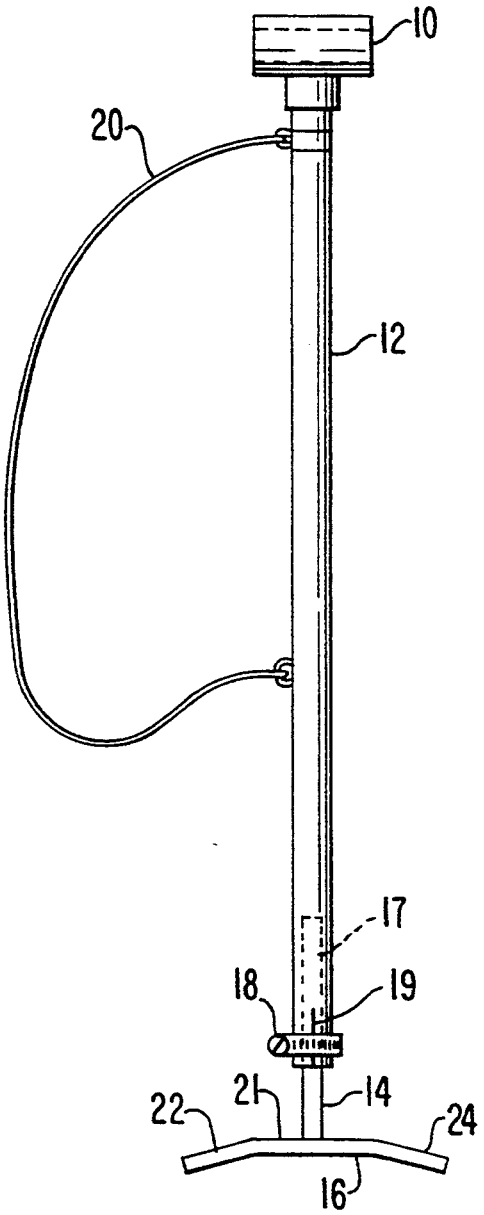
FIG. 1 is a schematic elevational view of the firearm support constructed in accordance with the invention.

In the firearm support according to FIG. 1, cylinder member 10 supports the firearm and is connected to one end of telescopic elongate element 12, and the other end of the telescopic elongate element 12 is arranged at one end of telescopic elongate element 14. The other end of telescopic elongate element 14 is connected to leg 16, which supports the firearm support. The telescopic elongate element 12 includes an axial aperture 17 for receiving telescopic elongate element 14. The telescopic elongate element 12 includes axial slits 19 at the other end of telescopic elongate element 12 to allow clamp 18 to compress telescopic elongate element 12 onto telescopic elongate element 14 by reducing the diameter of the axial aperture. The direction of the axial axis of cylinder member 10 is substantially perpendicular to the direction of the axial axis of telescopic elongate elements 12, 14 and is perpendicular to a direction of an axial axis of a gun barrel placed on cylinder member 10. Cylinder member 10 is covered with a suitable adherent padding material such as felt, foam or plastic, for example. The padded cylinder member 10 reduces muzzle jump by cushioning the firearm, absorbing the forces associated with the firing of the firearm and resulting in a more accurate shot. Without the padding material, the firearm could jump erratically as a result of the above-mentioned forces and the accuracy of the firearm could be adversely affected. Additionally, the padded cylinder member 10 prevents the finish of the firearm from being marred. By virtue of the padded cylinder member 10, if the operator of the firearm is employing a snub-nosed pistol, the operator's wrist may be placed on padded cylinder member 10 to provide support while the snub-nosed pistol is fired. Of course, if the snub-nosed pistol was placed directly on the padded cylinder member 10, a portion of the padding material could be separated from the cylinder member 10. With a long barrel pistol or rifle, the operator's fist could be placed between the cylinder member 10 and the long barrel pistol or rifle to absorb any residual shock not absorbed by the padded cylinder member 10.

Additionally, by virtue of the padded cylinder member 10, the targeted point of the firearm does not change as the firearm is fired. In contrast the targeted point would change with a rest not having the padding. This padding material assures that firearms which are zeroed off for hand shooting will also have the same targeted point. The cylinder member 10, telescopic elongated elements 12 and 14 and leg 16 may be formed by metal, a lightweight hard plastic, or wood. The cylinder member 10 additionally may have a flat region in the axial direction to provide a level support for the gun barrel. The entire firearm support may be pivoted on leg 16 forwardly or rearwardly to change the angle of the gun with respect to the horizontal without moving the position of the gun. Additionally, the firearm itself may be elevated or depressed to adjust the elevation of the firearm with respect to the horizon without an adjustment of the rest.

Figure 3:
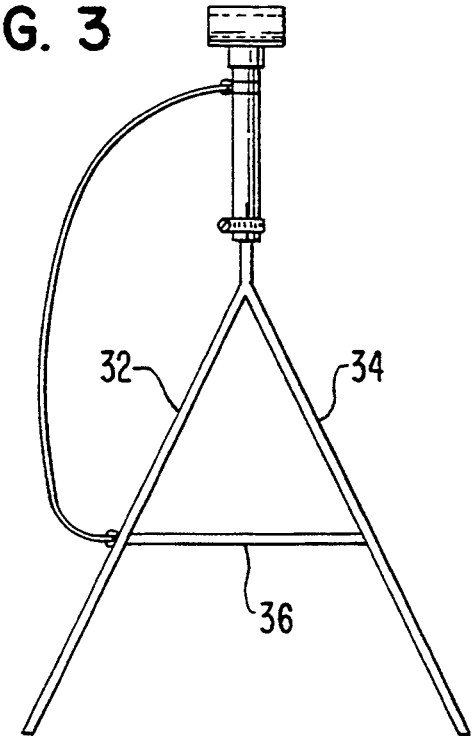
FIG. 3 is a schematic elevational view of the firearm support constructed in accordance with the present invention, with V-shaped legs and a cross member therebetween.

The perpetually open strap 20 may have both ends connected to telescopic elongate element 12 or one end of the perpetually open strap 20 may be connected to the telescopic elongate element 12, and the other end of perpetually open strap 20 may be connected to the leg element 32 as illustrated in FIG. 3. The perpetually open strap 20 is formed of sufficient rigid material such that the strap does not collapse under its own weight. The perpetually open strap 20 in combination with the firearm support provides a rigid, adjustable, rest that fits easily and comfortably over the operator's shoulder and is always ready to accept the arm and shoulder of the operator without the necessity of being opened or adjusted. Advantageously, the leg elements 21, 22 and 24 eliminate the necessity for a more complicated leg element design having two or more legs. Additionally, if the firearm support is employed in very soft soils or sand, the firearm support does not sink in the soft soil or sand since the weight of the firearm support and the firearm are spread over the entire bottom surface of the leg 16. The height of the firearm support is adjusted to the user's required height by a suitable adjustment of the telescopic elongate elements 12 and 14 and by adjustment of clamp 18. The cylinder member 10 is centered above the telescopic elongated elements 12 and 14 to provide a stable support for the gun.

While various heights of telescopic elongate elements may be employed, a firearm support which permits an adjustment in height of the support through a range up to an overall support height of approximately 30 inches permits the support to be used for a prone, a kneeling and a sitting position for most hunters.

The telescopic elongate element 14 may be a rod having a shaft length of between 21 inches to 22½ inches.

The foot of the user may be placed on the leg 16 of the firearm support to provide additional support to the firearm support. When the firearm support is not in user it may be transported utilizing the perpetually open strap 20 by placing the perpetually open strap 20 on the shoulder of the user to provide easy transport or hung away by hanging the perpetually open strap 20 on a hook.

It will be noted that the cylindrical member 10 supports a barrel of a rifle or gun or the stock of a rifle so that the gun may be very quickly turned to follow a target. Since the gun rests on the cylinder 10, uniform support and uniform resistance are provided as the gun is moved up and down and from side to side, and it can be appreciated that the target could be followed with the gun through a range of movement of approximately 180° both horizontally and vertically without the necessity of moving the firearm support.

As illustrated in FIG. 1, leg 16 comprises three leg elements 21, 22, 24. The leg elements 22, 24, both, form an oblique angle with respect to leg element 21, which is substantially horizontal. The length of leg elements 21, 22, 24, may vary and the oblique angle formed by leg elements 21, 22, 24 may also vary.

Figure 2:
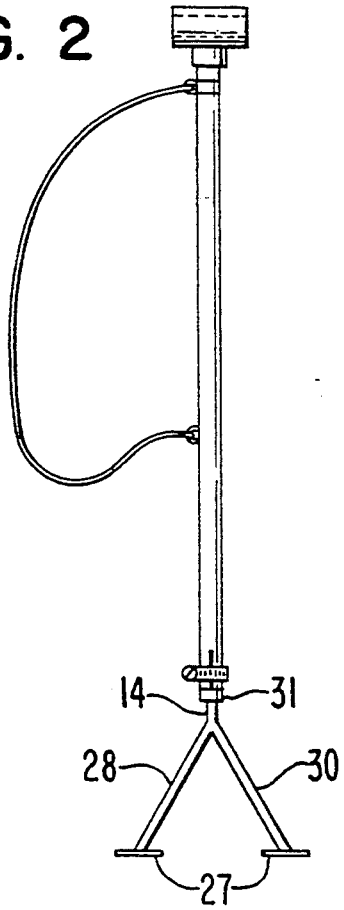
FIG. 2 is a schematic elevational view of the firearm support constructed in accordance with the present invention, with V-shaped legs.

As illustrated in FIG. 2, leg element 28 forms an oblique angle with respect to leg element 30 and an obtuse angle with respect to telescopic elongate element 14. Additionally, each of leg elements 28, 30 may have feet 27 attached to provide additional support and stability to the firearm support.

Figure 10:
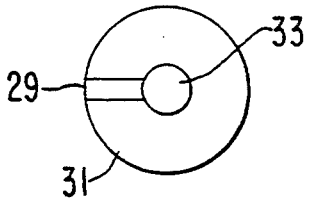
FIG. 10 is a schematic top cross-sectional view of a shaft collar constructed in accordance with the present invention.
Figure 11:
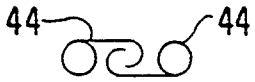
FIG. 11 is a schematic top elevational view of a pair of clamps constructed in accordance the present invention.

A shaft collar 31 is mounted on telescopic elongate element 14 as illustrated in FIG. 2 and FIG. 10. This shaft collar 31 is cylinder shaped and includes a axial aperture 33 for accepting the telescopic elongate element 14 to hold the telescopic elongate element 14 in a fixed position. A radial internally threaded aperture 29 as illustrated in FIG. 10 accepts a screw such as an allen set screw (not shown) for engaging the element 14 to hold the telescopic elongate element 14 in a first position. The shaft collar 31 allows the telescopic element 12 to be fixed at a predetermined position with respect to element 14. Additionally, the leg 28 could be hinged to pivot together and the support would serve the dual purpose of a walking stick.

As illustrated in FIG. 3, telescopic elongate element 14 is integral with leg elements 32, 34 and 36; element 32 forms an oblique angle with respect to leg element 34, and leg element 36 is connected substantially horizontally between leg element 32 and leg element 34; leg element 36 forms an oblique angle with each of leg elements 32 and 34. The leg element 36 provides support for leg elements 32, 34; thus preventing leg elements 32, 34 from bending due to the weight of firearm support and the firearm. As a consequence, leg elements 32, 34 can be constructed to have a small cross sectional size. Leg element 36 may be substantially perpendicular to telescopic elongate element 14 and substantially horizontal.

Figure 5:
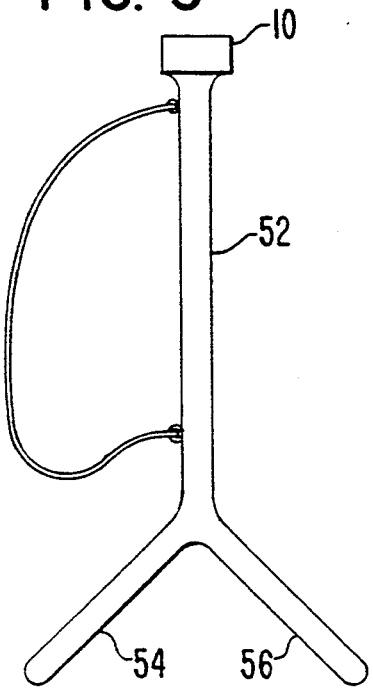
FIG. 5 is a schematic elevational view of a firearm support constructed in accordance with the present invention, with an integral structure.
Figure 6:
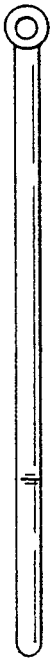
FIG. 6 is a side schematic elevational view of the firearm support constructed in accordance with the present invention, with an integral cylinder member elongate support member and legs.

Illustrated in FIGS. 5 and 6, is a firearm support in which the cylinder member 10, the elongate element 52 and the leg elements 54, 56 are integral. The overall height of the firearm support may be 21 inches to 26 inches, and the width of the firearm support may be between 8 inches to 10 inches. This firearm support could be made out of wood or plastic, for example. In any of the firearm supports described herewithin, the legs may be replaced by a spike to penetrate the ground and to hold the firearm support upright, A disk may be provided on the spike to prevent accidental injury.

Figure 4:
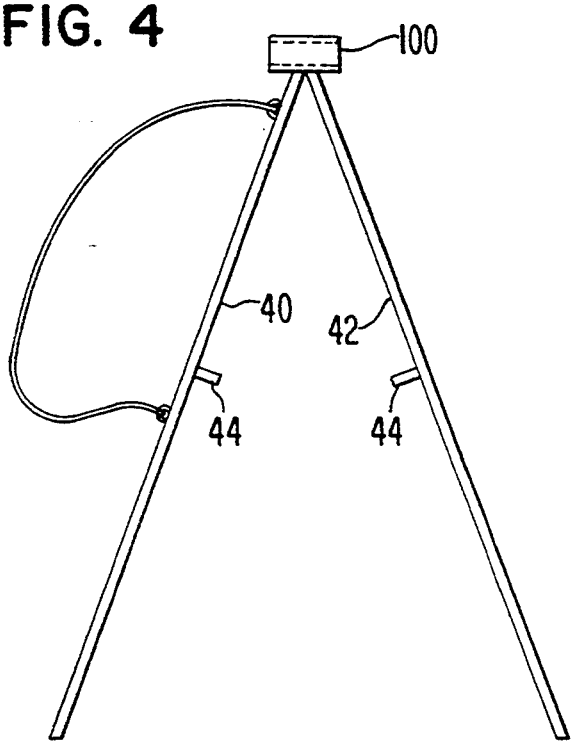
FIG. 4 is a schematic elevational view of a firearm support constructed in accordance with the present invention, with two pivotable legs directly connected to the cylinder.

As illustrated in FIG. 4, leg elements 40, 42 are directly pivotably mounted on cylinder 100 such that each of the leg elements forms an oblique angle with the other leg element. The firearm support could serve as a walking stick with the legs 40, 42 pivoted together.

Figure 7:
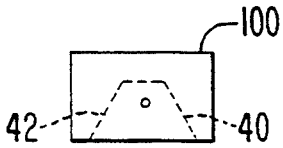
FIG. 7 is a schematic cross-sectional view of the cylinder constructed in accordance with the present invention.

FIG. 7 illustrates the leg elements 40, 42 pivoted apart and directly connected within cylinder member 100. See also FIG. 7 for a schematic cross-sectional view of the arrangement.

Figure 8:
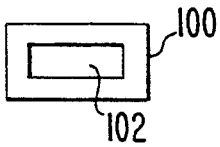
FIG. 8 is a schematic bottom elevational view of the cylinder member constructed in accordance with the present invention with a hole to accept the pivotable legs.
Figure 9:
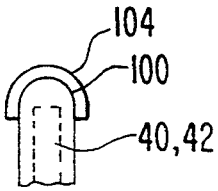
FIG. 9 is a schematic side cross-sectional view of the cylinder member constructed in accordance with the present invention, with the two leg elements being pivotably mounted.

FIG. 8 illustrates the aperture 102 of cylinder member 100 for pivoting leg elements 40, 42. FIG. 9 is a side view of cylinder member 100 and the pad 104 of cylinder member 100.

Figure 12:
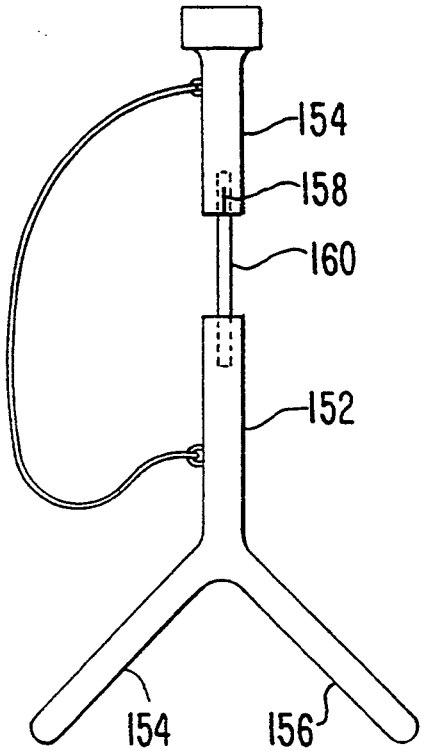
FIG. 12 is a schematic cross-sectional view of the firearm support constructed in accordance with the present invention, with the legs being integral with a telescopic elongate element.

FIG. 12 illustrates an upper telescopic elongate element 154 including an axial slit 158 and a radial aperture to engage elongate element 160 for adjusting the height of the firearm support. The elongate element 160 is fixed to a corresponding radial aperture in element 152. Element 154 is clamped by a clamp (not shown) to engage elongate element 160. This arrangement provides the advantage of the integral structure and can be compactly stored.

Figure 13:
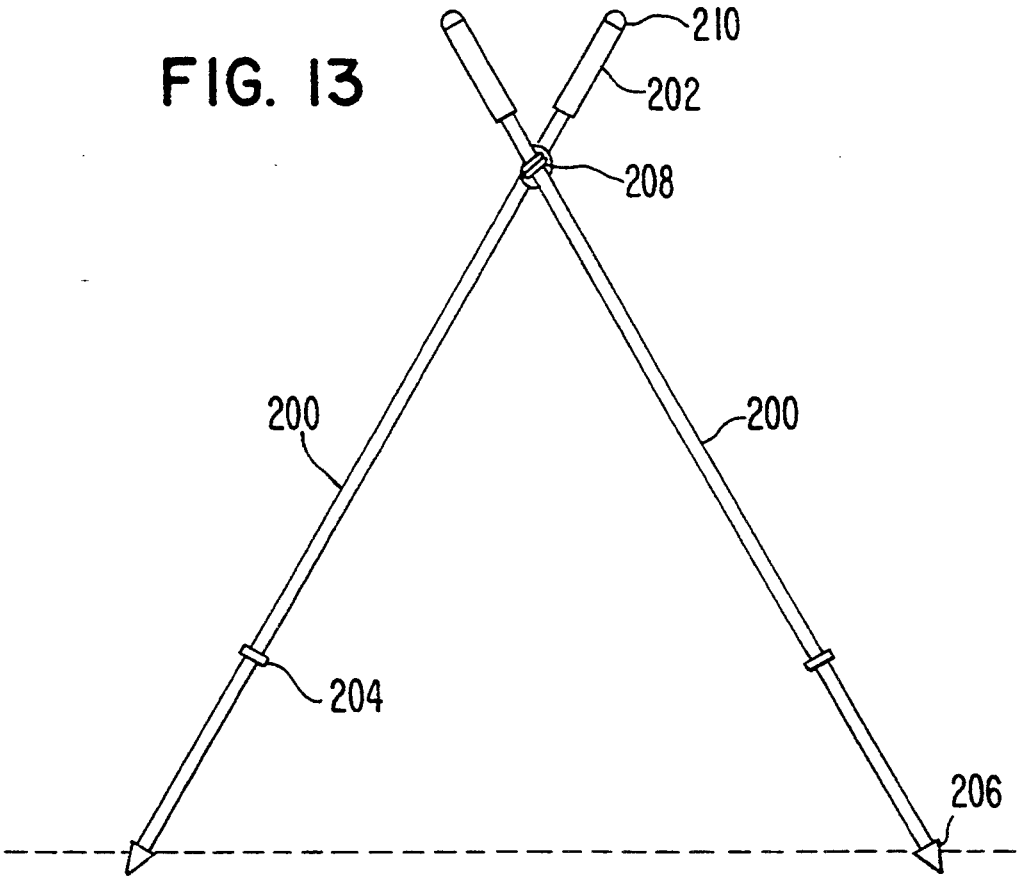
FIG. 13 is a schematic elevational view of the firearm support constructed in accordance with the present invention, with two elongate members being pivotably joined.
Figure 14:
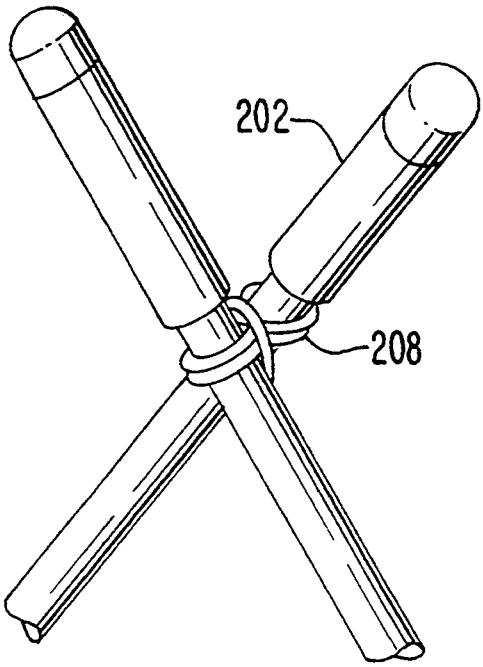
FIG. 14 is a schematic perspective view of the firearm support in accordance with another feature of the invention.

A firearm support, in accordance with another feature of the invention, is illustrated in FIGS. 13 and 14. The firearm support includes two elongate members 200 preferably two cylinders 200 which are hollow. The elongate members 200 are joined by two and three flexible coupling members 208. One or a pair of the flexible coupling members 208 are Figure eight shaped defining two holes and the two elongate members 200 are positioned within the holes formed by the flexible coupling member. Alternatively, both elongate members 200 could be positioned within a single hole of the flexible coupling member 208. The third flexible coupling member 208 is positioned perpendicular to the pair of Figure eight shaped coupling members to maintain a space and is positioned between the elongate members 200. One end 206 of the elongate member 200 may be pointed to achieve a grip on a slick surface. Additionally, if one end 206 is pushed into the ground, the user does not have to hold the firearm support. The firearm support has, located at an upper end of the elongate member 200, a padding material serving as a cushion.

The elongate member 200 may have a pair of spacers 204 mounted at a lower end thereof to maintain the spacing of elongate member with respect to each other.

One of elongate members 200 is pivoted with respect to the other so that the elongate members 200 form a X shape. As a result of the elasticity of flexible coupling members, the elongate members retain the X shape, and this operation can easily be performed with one hand. The flexible coupling members may be o-rings which have a hole of a diameter of between ½" to 9/16" and a thickness of 0.139". The material of the flexible coupling member could be neoprene, poly urethane, bunanitrate (BN) or ethylene propylene (EP). The elongate member is placed on the ground; the pointed ends aid in maintaining the elongate member on a slick surface. A rifle or pistol is placed between the elongate members or the padded material.

The elongate members advantageously could include a damping apparatus to eliminate noise. An insulating material could cover the elongate members to reduce noise and protect the firearm from being moved. Additionally the elongate member could be hollow and filled with cotton or foam to dampen noise.

This constitution provides a very light weight firearm rest, for example, 5 oz. in weight, which is portable and operable with one hand. Another feature of the invention is that the firearm is approximately 32 in. high with the flexible coupling member being placed approximately 4¾" from the top of the elongate members. The spacing members can be placed advantageously between 7" and 20" from the flexible coupling member. The flexible coupling member could be made of rubber which allows the firearm support to flex slightly when the firearm is fired. This is similar to the cushioning effect of a hand held firearm, for example, without a firearm support.

Figure 15:
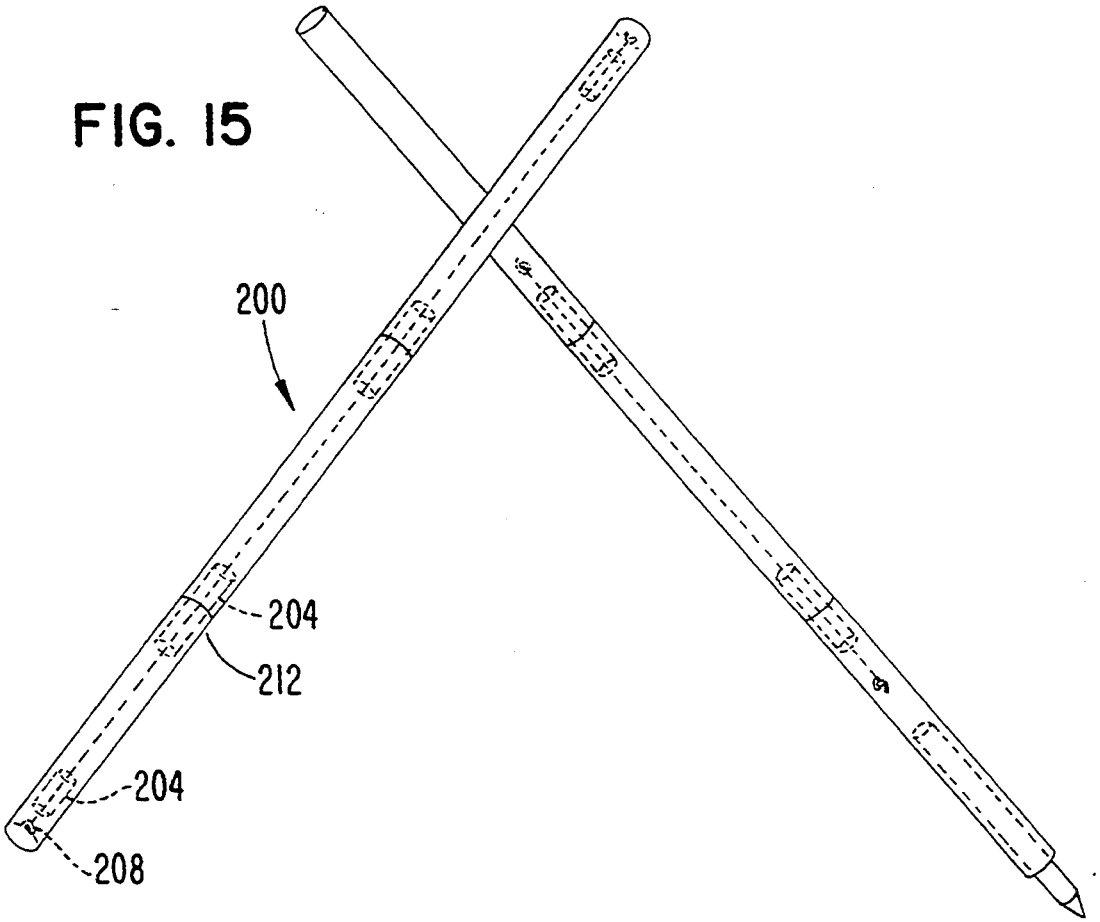
FIG. 15 is a schematic elevational view of another firearm support in accordance with a further feature of the invention illustrating two elongate members which are crossed.
Figure 16:
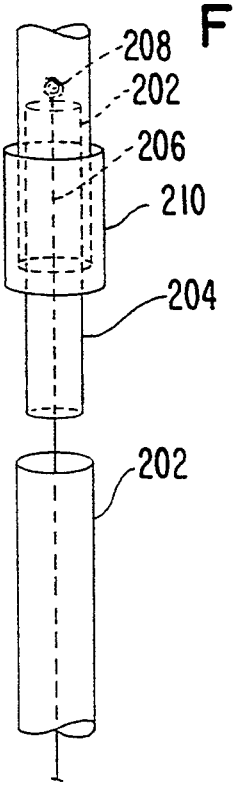
FIG. 16 is a schematic elevational view of one elongated member of the invention.

Another feature of the invention is illustrated in FIGS. 15–23. As illustrated in FIG. 15, two elongate members 200 are crossed at the upper portions of the elongate members 200 and are elastically joined together as shown in FIGS. 13 and 14 and as described above. As illustrated in FIG. 16, two cylinder segments 202 are joined by a positioning cylinder 204. One end of positioning cylinder 204 is fixedly joined onto one end of one of the cylinder segments 202, and another end of positioning cylinder 204 is slidingly joined to an end of the other cylinder segment 202. An elastic member 206 extends through cylinder segments 202 and positioning cylinder 204. The elastic member 206 is stretched and exerts a force on each cylinder segment 202 such that each cylinder segment 202 remains abutted to the other and positioned on positioning cylinder 204. The elastic member 206 may be stretched and retained in a retained position by forming a knot or a holding member 208 at the end of the elastic member 206. The holding member 208 has a greater diameter than the diameter of the aperture through the positioning cylinder 204. A noise reducing cylinder 210 is fixed on each upper segments of the elongate members 200 shown in FIG. 16 and prevents the two segments of an elongate member and the two elongate members 200 from making noise as they are pivoted.

Figure 17:
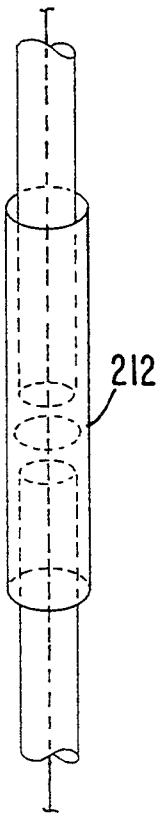
FIG. 17 is a partial elevational view of the firearm support with a noise reducing member.

As illustrated in FIG. 17, the noise reducing cylinders 210 could be made from vinyl tubing which is positioned over the outside of each joint, forming a damper to reduce the clicking noises when the two outer and center cylinder segments are joined together, and the noise reducing cylinder 210 also holds the segments together by frictionally joining the center cylinder segment and the outer cylinder segment, holding the cylinder segments 202 together when the gun rest is being repositioned during use. For example, the noise reducing cylinder could be positioned to cover approximately one or three quarters inches of the end of the outer cylinder segment 202 with approximately ⅛ inch to engage the center cylinder segment 202. The noise reducing cylinder 210 insulates the outer cylinder segment 202 from the center cylinder segment 202 even when the cylinder segments 202 are folded and adjacent to each other or extended and two cylinder segments are joined with each other. An alternate configuration is one in that the noise reducing ring 212 is placed inside the cylinder segment 202 to reduce clicking noises when the two cylinder segments come together.

Figure 18:
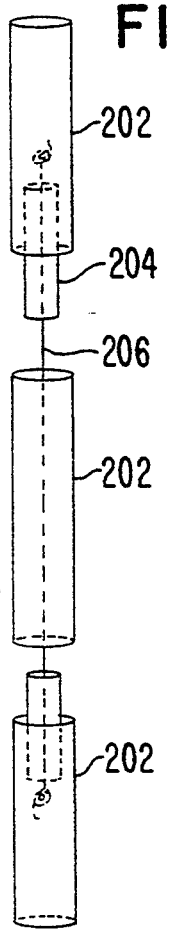
FIG. 18 is a schematic partial elevational view of a elongated member in accordance with the invention.
Figure 19:
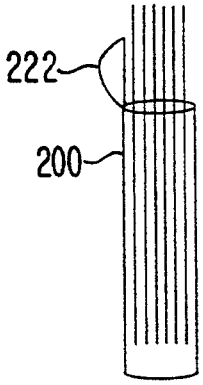
FIG. 19 is an cross-sectional view of a carrying pouch in accordance with the further features of the invention.
Figure 21:
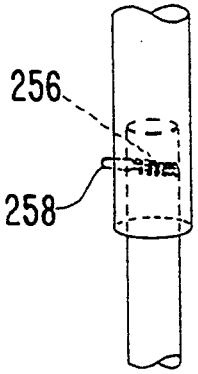
FIG. 21 is a partial cross-sectional view of the firearm support in accordance with the invention with a spring loaded returning pin.
Figure 22:
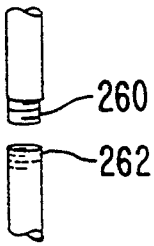
FIG. 22 is a partial cross-sectional view of the firearm support constructed in accordance with the present invention having ends which are threaded.

As illustrated in FIG. 18, three cylinder segments 202 are spaced apart from each other and the elastic member 206 is stretched providing a tensioning force urging the two outer elongate members 202 towards the center cylinder segment 200. The outer cylinder segment 202 with positioning cylinder 204 approaches the center cylinder segment 202 reducing the force urging the two outer cylinder segments 202. The center cylinder segment 202 engages the positioning cylinder 204 and is guided by positioning cylinder 204 to abut against an end of outer cylinder segment 202. Thus, the elongate member 200 is formed and ready to be crossed with another elongate member 200 to form a rifle or pistol rest.

To fold the firearm rest, one of the outer cylinders 202 are extended to a position where the positioning cylinder 204 no longer engages the center cylinder 202. The outer cylinder 202 is pivoted to a position adjacent to and parallel to the center cylinder 202. The procedure is repeated for the other outer cylinder segment and the now folded firearm and rest is placed in the pouch.

Figure 20:
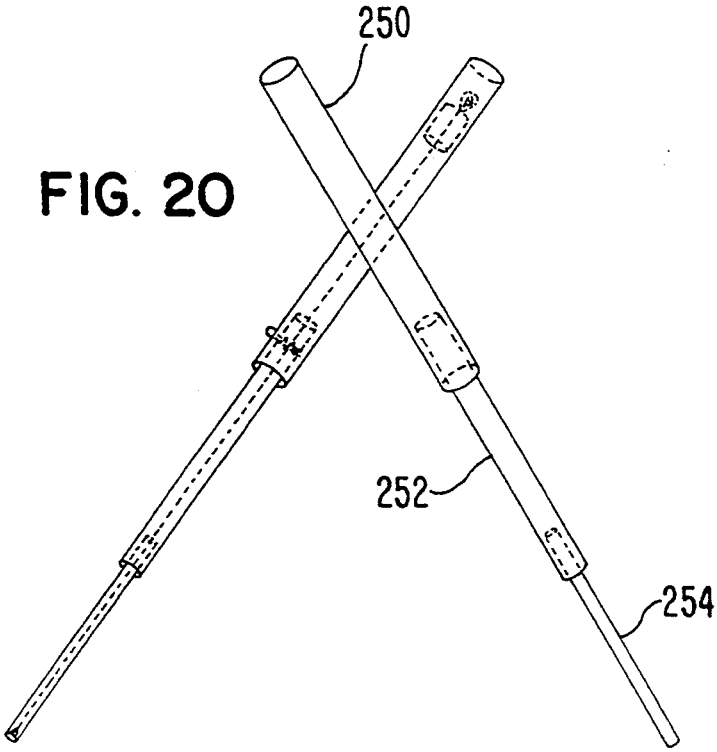
FIG. 20 is a schematic elevational view of the firearm support in accordance with a further feature of the invention.

As illustrated in FIG. 20, two elongate members 248 are connected by the connecting member described hereinabove to form a pistol or gun rest. Elongate member 248 is constructed with telescoping cylinders. For example, the second cylinder 252 telescopes into the first cylinder 250, and the third cylinder 254 telescopes into the second cylinder 252. As with the previous feature of the present invention, an elastic member 206 is extended through the first, second, and third cylinder members 250, 252, 254 respectively. The first cylinder 50, second cylinder 252 and the third cylinder 254 are of congruent construction so that when the respective cylinders are not extended each cylinder is positioned within the respective large cylinder.

However, to maintain the second cylinder 252 and the third cylinder 254 at an extended position while in use various alternatives are possible. One alternative would be to provide a spring 256 and pin 258, which extends through a hole in the first cylinder 250 or the second cylinder 252 to maintain the second cylinder 252 or the third cylinder 254 respectively in the extended position. The pin is retractable within a second or third cylinder 252,254 thereby the second or third cylinder 252, 254 may be telescoped within the first or second cylinder 250, 252 respectively.

A second alternative would be to have one end of the first cylinder 250 and the second cylinder 252 threaded with internal threads 260 to engage external threads 262 provided on one end of the second cylinder 252 or the third cylinder 254. Thus one end of the cylinder can be threaded to the other end of the other cylinder by threads 260 and 262.

Figure 23:
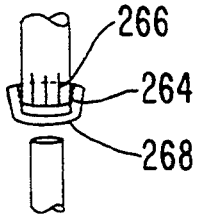
FIG. 23 is a partial schematic cross-sectional view of the firearm support with threaded cup.

Another alternative as illustrated in FIG. 23 is to provide one end of the first or second cylinder 250, 252 with radial slits 266 and the same end is provided with external threads 264. The cap member 268 has internal threads to engage external treads 264. The cap member 268 compresses the cylinder and thereby retains the another smaller diameter cylinder located within. The threads 264 could be tapered to compress the outer cylinder and the inner cylinder.

The elongated member 248 initially has third cylinder 254 telescoped within second cylinder 252 which is telescoped within first cylinder 250. The second cylinder 252 is extended from the first cylinder 250 extending the elastic member 206; the one end of the first cylinder 250 is attached to the other end of second cylinder 252 so that the second cylinder 252 remains extended from the first cylinder 250. The third cylinder 254 is extended from the second cylinder 252 and the one end of the second cylinder 252 is attached to the other end of the third cylinder 254. The other elongate member 258 is extended in the same manner and the two elongated members 248 are attached as described hereinabove.

Figure 24:
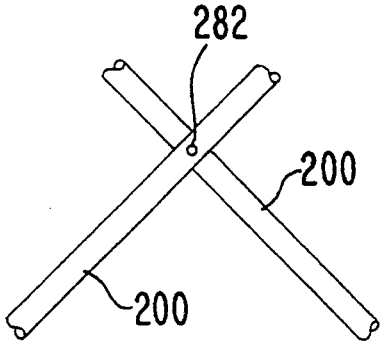
FIG. 24 is a partial schematic side elevational view of an alternative joint of the firearm support.
Figure 25:
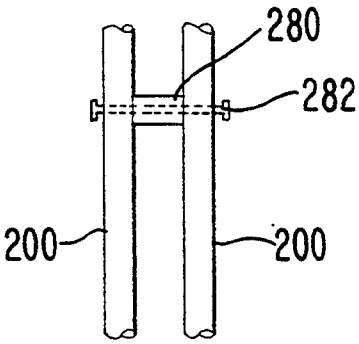
FIG. 25 is a cross-sectional front view of the alternative joint.

Additionally, as illustrated in FIG. 13 and FIG. 24 the two elongate members could be pivotably connected by a pin 282 which is journaled through the two elongated members, and the two elongate members are spaced apart by a spacer placed between the two elongated members.

Alternately, the elongate members could be pivotally joined by a flexible pivot member 400 as illustrated in FIGS. 26 and 27. The pivot member includes a pair of holes 402 to engage the elongate members 200.

The pivot member could be constructed with a joining pin 404 and a pair of engaging members 406 to engage the elongate members 200. The joining pin 404 allows one elongate member 200 to pivot with respect to the other elongate member 200. Each engaging member 406 includes a hole to engage its elongate member 200 as shown in FIGS. 28 and 29. The engaging members 406 are spaced from each other so that the elongate members 200 do not bind each other due to the insulating material.

FIG. 30 illustrates another elongate member 500 including first cylinder 502 and second cylinder 503. First cylinder 502 includes a narrowed tapered cylinder which frictionally engages an aperture 504 of either first cylinder 502 or second cylinder 503. Second cylinder 503 is similar to first cylinder 502 except that the second cylinder 503 does not have a narrowed tapered cylinder. FIG. 32 shows two elongate members 500 joined by other flexible coupling members as described therein.

While I have shown and described several embodiments in accordance with the present invention, it is understood that the same is not limited thereto but is susceptible to numerous modifications as known to one skilled in the art and I, therefore, do not wish to be limited to the details described herein but intend to cover all such modifications as are encompassed by the scope of the appended claims.

I claim:

1. A rifle and pistol rest which can be assembled in a setup position for supporting a device such as a firearm or an optical instrument and disassembled from said setup position to reduce a length of said rest for easy transport, said rest comprising two elongate members and means for pivotally connecting said two elongate members intermediate the ends thereof so that the elongate members can be pivoted to cross one another in the form of an X shape, each of said two elongate members including at least two elongate segments and means for releasably coupling said elongate segments to one another in end to end relation in said setup position of the rest.

2. A rifle and pistol rest according to claim 1, wherein said means for releasably coupling includes portions of said segments which telescope with one another at least when said rest is in said setup position.

3. A rifle and pistol rest according to claim 1, wherein said means for pivotally connecting includes a pivot member connected to each of the two elongate members.

4. A rifle and pistol rest according to claim 1, wherein at least one end of each of said elongate members is covered with a rubber tip.

5. A rifle and pistol rest according to claim 1, wherein the lower end of each of said elongate members of said rest is provided with a shaft point to prevent the rest from slipping on slick surfaces.

6. A rifle and pistol rest according to claim 1, further comprising a padded portion on each of said two elongate members forming the upper portion of said X shape when said rest is assembled in said setup position for preventing marring of the finish of said device supported thereon.

* * * * *